US011434045B2

(12) United States Patent
Son

(10) Patent No.: US 11,434,045 B2
(45) Date of Patent: Sep. 6, 2022

(54) SAFETY-ENHANCED CAN LID

(71) Applicant: Kijung Son, Gumi-si (KR)

(72) Inventor: Kijung Son, Gumi-si (KR)

( * ) Notice: Subject to any disclaimer, the term of this patent is extended or adjusted under 35 U.S.C. 154(b) by 49 days.

(21) Appl. No.: 16/767,581

(22) PCT Filed: Jul. 8, 2019

(86) PCT No.: PCT/KR2019/008339
§ 371 (c)(1),
(2) Date: May 27, 2020

(87) PCT Pub. No.: WO2020/017802
PCT Pub. Date: Jan. 23, 2020

(65) Prior Publication Data

US 2020/0385168 A1 Dec. 10, 2020

(30) Foreign Application Priority Data

Jul. 19, 2018 (KR) ..... 10-2018-0083998

(51) Int. Cl.
*B65D 17/28* (2006.01)

(52) U.S. Cl.
CPC .. *B65D 17/4011* (2018.01); *B65D 2517/0013* (2013.01)

(58) Field of Classification Search
CPC ..... B65D 77/2024; B65D 17/4011
USPC .... 220/359.2, 359.1, 359.4, 62.11, 657, 729, 220/255, 718; 215/232, 250; 229/125.35; D9/438
See application file for complete search history.

(56) References Cited

U.S. PATENT DOCUMENTS 264,102 A * 9/1882 Quehl ..... B65D 77/2024 220/359.4
4,040,540 A 8/1977 Ostrem et al.
6,109,515 A * 8/2000 Duboff ..... B65D 43/0206 229/5.5
6,588,619 B2 * 7/2003 Cardarelli ..... B65D 17/4011 206/315.9

(Continued)

FOREIGN PATENT DOCUMENTS

CN 101225910 A * 7/2008
EP 0001690 A1 * 9/1978 ..... B65D 7/38

(Continued)

OTHER PUBLICATIONS

International Search Report of PCT/KR2019/008339 published on Jan. 23, 2020.
Written opinion of PCT/KR2019/008339 published on Jan. 23, 2020.

*Primary Examiner* — Valentin Neacsu
*Assistant Examiner* — John Martin Hoppmann

(57) ABSTRACT

The present invention relates generally to a safety-enhanced can lid, and more particularly to a safety-enhanced can lid in which a prevention portion configured to prevent a user's hand from being cut is provided along the edge of the lid that is coupled to seal a can, thereby enabling safe use. For this purpose, the present invention provides a can lid that is coupled to the top side of a container in which contents are stored, the can lid including: a plate laid to cover the top portion of the container, composed of a flat plate, and provided with a pull tab on the top surface thereof; and a hand-cut prevention portion including a cut prevention wall bent downward from the edge of the plate toward the container.

4 Claims, 4 Drawing Sheets

(56) References Cited

U.S. PATENT DOCUMENTS

| | | | | |
|---|---|---|---|---|
| 2006/0214430 | A1* | 9/2006 | Wolfgang | B65D 17/502 292/80 |
| 2014/0030390 | A1* | 1/2014 | Coyle | B65D 43/02 426/123 |

FOREIGN PATENT DOCUMENTS

| | | | | | |
|---|---|---|---|---|---|
| JP | 2002012230 | A | * | 1/2002 | |
| JP | 2002012230 | A | | 1/2002 | |
| KR | 200310549 | Y1 | | 4/2003 | |
| KR | 20120096249 | A | * | 2/2011 | |
| KR | 20120096249 | A | * | 8/2012 | B65D 17/4011 |
| KR | 1020130056257 | A | | 5/2013 | |
| KR | 20150124081 | A | * | 4/2014 | |
| KR | 200478678 | Y1 | | 11/2015 | |
| KR | 1020150124081 | A | | 11/2015 | |
| KR | 101875335 | B | | 7/2018 | |

* cited by examiner

SAFETY-ENHANCED CAN LID

CROSS REFERENCE TO RELATED APPLICATIONS

This application is a national entry application of International Application No. PCT/PCT/KR2019/008339 filed on Jul. 8, 2019, which claims priority to Korean Application No. 10-2018-0083998 filed on Jul. 19, 2018, the entire contents of which are herein incorporated by reference in its entirety.

TECHNICAL FIELD

The present invention relates generally to a safety-enhanced can lid, and more particularly to a safety-enhanced can lid in which a prevention portion configured to prevent a user's hand from being cut is provided along the edge of the lid that is coupled to seal a can, thereby enabling safe use.

TECHNICAL BACKGROUND

In the past, there were used cans in which containers and lids were integrated with each other. In other words, such a can was released from a factory with the edge of a container and the edge of a lid integrated with each other, and thus a user removed the lid by cutting off the lid by using a dedicated opener having a sharp blade.

Thereafter, cans with so-called "one-touch" lids appeared. In general, such a can includes a container filled with contents therein and a lid provided to open and close the top of the container, and is configured such that the lid is separated from the container in such a manner that a user pulls a pull tab attached to the lid.

In this case, a common can or tin (hereinafter collectively referred to as a "can") is composed of a thin plate made of sterilized tin or aluminum. When a lid is separated from a container, accidents in which a user's hand is cut by the edge of the exposed lid have occurred frequently, and thus various methods have been proposed to prevent such accidents.

As a conventionally proposed technology, there is Korean Patent No. 10-1875335 (registered on Jun. 2, 2018; hereinafter referred to as "prior art 1"). Prior art 1 relates to the "safe opening cap" for opening the can lid of a can including a protruding rim formed to protrude from the top of the can containing food, a can lid formed inside the protruding rim and configured to cover the top of the can, and a full tab configured such that one side thereof is coupled to the can lid, the safe opening cap including: a cap body configured to form a container; an outer wall extended downward from the outer circumferential surface of the cap body; a pull tab lifting portion formed to protrude from the top surface of the cap body to a predetermined thickness and to have an inclined surface; and a pull tab passage means formed on the top surface of the cap body and configured to form a space into which the pull tab can be inserted when the cap body is pressed downward.

Prior art 1 configured as described above relates to the safe opening cap that is coupled to the can lid. The safe opening cap has problems in that manufacturing cost increases because each safe opening cap has to be manufactured separately according to the size of a can and it is inconvenient to use the safe opening cap.

Furthermore, Korean Utility Model Registration No. 20-0310549 (registered on Apr. 2, 2003; hereinafter referred to as "prior art 2") provides a "one-touch type safe can."

Prior art 2 discloses the one-touch type can having an opener configured to tear off a can lid along a tear-off line formed on the edge portion of the can lid in order to open a can container in which predetermined contents are stored, which includes a cover member attached to the top surface of the can lid to surround the torn surface of the can lid when the can lid is torn off by the opener and provided with a hole that substantially exposes the opener to the outside.

Prior art 2 also prevents accidents such as cuts of hands through the separate cover member attached to the top surface of the can lid. However, like in prior art 1, the cover member has to be separately manufactured according to the size of the can, thereby causing problems in that manufacturing cost increases and it is inconvenient to use it.

In other words, like in prior arts 1 and 2, the safety covers provided in the conventional cans are manufactured separately from the cans, attached or coupled to the can lids, and then used, thereby increasing manufacturing cost and also causing the inconvenience of use.

Furthermore, the prior arts are configured to protect a user's hand by first inserting a safety cover or the like into the can so that the can lid is covered before opening the can lid and then opening the can lid. However, when the can lid is opened from the container, the safety cover remains inserted into the lid as it is. Accordingly, in the process in which the can lid is lifted and opened, the outer circumferential surface of the can lid is exposed, thereby failing to completely protect the hand against a cut.

Meanwhile, there is a can provided with a can lid made of a paper material such as silver foil. The can lid made of a paper material as described above has problems in that it is easily damaged by a small amount of impact and damage occurs due to collision when the can is stored along with other items during travel and in that the can does not meet the intrinsic purpose of a can because it is difficult to store contents for a long period of time due to heat shrinkage and expansion during the long-term storage of the can.

Therefore, there is an increasing demand for a lid for a can that has an improved structure and can thus prevent a user's hand from being cut when the can lid is opened from a container or even after it has been opened.

DETAILED DESCRIPTION

Problems to be Solved

The present invention has been proposed to overcome the above-described problems and to meet the needs of consumers, and an object of the present invention is to provide a safety-enhanced can lid that has an improved structure, so that the safety of use is improved by preventing a user's hand from being cut, which is implemented without a need for an additional member, thereby improving the convenience of use.

Solution to Solve the Problem

In order to accomplish the above object, the present invention provides a can lid that is coupled to the top side of a container in which contents are stored, the can lid including: a plate laid to cover the top portion of the container and provided with a pull tab on the top surface thereof, and a hand-cut prevention portion including a cut prevention wall bent downward from the edge of the plate toward the edge of the container.

Furthermore, the cut prevention wall is formed to have a vertical length of about 1 to 3 mm.

Moreover, the can lid further includes a flange detachably coupled from the plate and provided at the front end of the cut prevention wall inward to the center

Advantages of Invention

The present invention configured as described above relates to a can lid for canning, in which the cut prevention wall is provided below the edge of the plate of the can lid, so that the plate is bent toward the center of the bottom surface when the lid is separated from the container, thereby providing the effect of preventing a user's hand from being cut, and so that manufacturing cost may be reduced because there is no need for a separate member such as a safety cover and manufacturing may be made without significantly modifying or altering the existing manufacturing equipment, thereby providing the effect of reducing costs.

Furthermore, the safety-enhanced can lid according to the present invention does not damage a user's body, such as the hand, the leg or the like, or a tire of a bicycle, a quick board, an automobile, or the like even when coming into contact with it during a process in which the can lid is discarded after being separated from a container or the can lid is selectively collected for recycling, thereby improving safety.

In other words, even in the state in which the can lid is completely separated from the container, the sharp cut surface is not exposed to the outer circumferential surface but is disposed in the state of being bent toward the center of the bottom surface, and thus advantages are provided in that safety accidents such as a hand cut caused by a user's carelessness are prevented in advance and recycling collection bags are not damaged.

EMBODIMENTS

Objects of the present invention other than the above-described object and features of the present invention will be apparent through descriptions of the embodiments given with reference to the accompanying drawings.

Unless defined otherwise, all terms, including technical or scientific terms, used herein have the same meanings as commonly understood by those having ordinary skill in the art to which the present invention pertains. Terms such as those defined in commonly used dictionaries should be interpreted as having meanings consistent with meanings in the context of related technologies, and should not be interpreted as ideal or excessively formal meanings unless explicitly defined in the present application.

Preferred implementations of a safety-enhanced can lid according to the present invention will be described in detail below with reference to the accompanying drawings.

Figure 1:
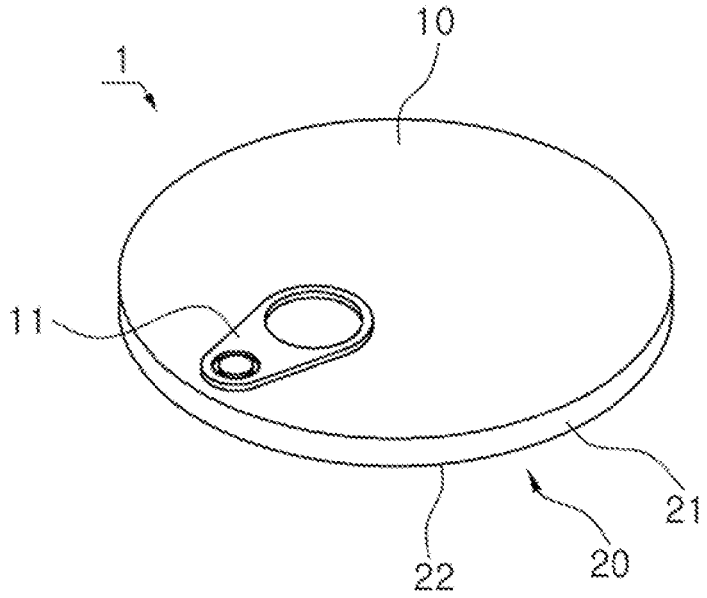
FIG. 1 is a view showing an example of a safety-enhanced can lid according to the present invention.
Figure 2:
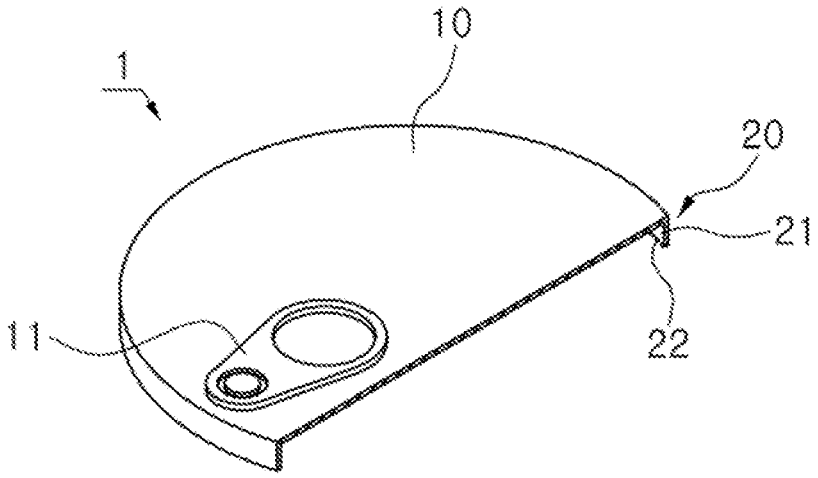
FIG. 2 is a view showing an example of a hand-cut prevention portion according to the present invention.
Figure 3A:
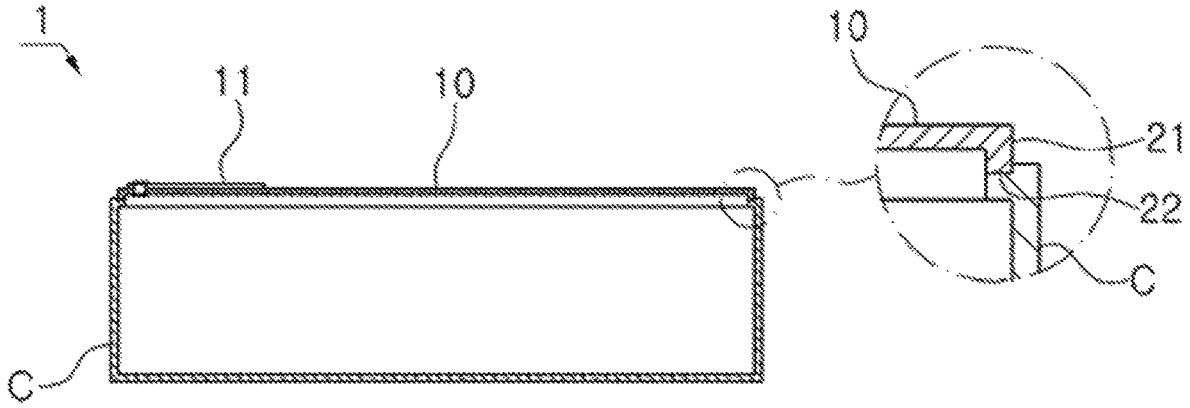
FIG. 3 show diagrams illustrating the use state of the can lid according to the present invention.
Figure 3B:
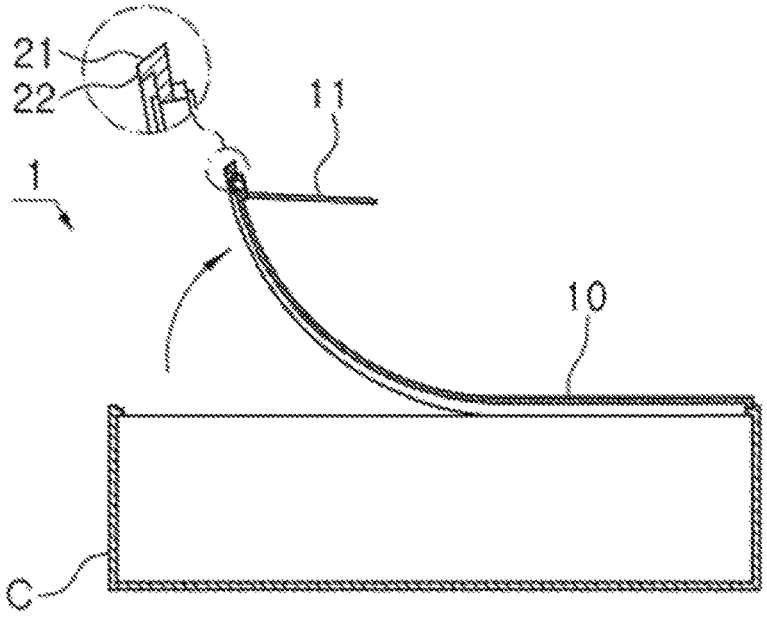
Figure 3C:
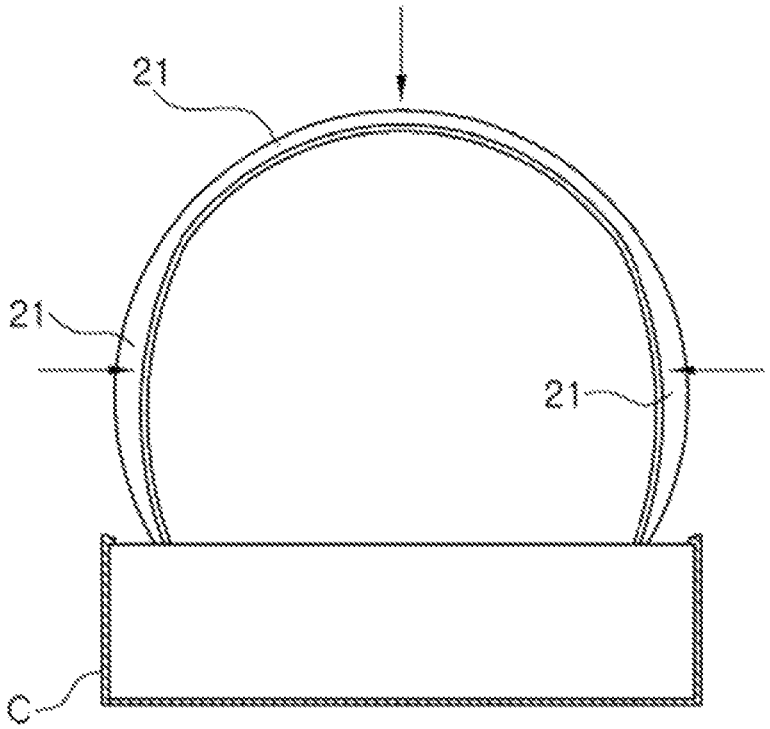

As shown in FIGS. 1 to 3, a safety-enhanced can lid 1 according to the present invention includes a plate 10, a pull tab 11, and a hand-cut prevention portion 20.

The plate 10 is laid to cover the top of a container C, and is formed in a flat plate shape. Although the plate 10 is shown in a circular shape, it is not limited thereto. When the shape of the container is circular, the plate 10 of the present invention is also formed in a circular shape. In contrast, when the shape of the container is square or rectangular, it is natural that the plate 10 of the present invention is also square or rectangular.

The hand-cut prevention portion 20 is intended to prevent a user's finger or wrist from being cut by the edge of the plate 10 during or after the process of lifting the plate 10 upward from the container C. The hand-cut prevention portion 20 includes a cut prevention wall 21 that is bent downward from the edge of the plate 10 toward the container C.

In this case, it is preferable that a portion where the cut prevention wall 21 and the plate 10 are connected to each other, i.e., the edge front end of the plate 10, is polished through a separate polishing operation of polishing a sharp portion in order to prevent a user's hand from being cut when the plate 10 is torn off.

The cut prevention wall 21 is formed by being bent from the edge of the body 10 toward the edge of the container, i.e., downward, and the bent front end comes into contact with the open edge of the upper end of the container C and forms a tear-off portion 22. The front end comes into contact with the open edge of the container, is bonded by a common bonding method or connected and fastened and is then distributed, and is separated by a user's external force.

When a user separates the body 10 upward from the container C by using the pull tab 11, the cut prevention wall 21 minimizes the exposure of the tear-off portion 22, i.e., the front end of the cut prevention wall, to the outside and allows it to be bent inward, thereby preventing the user's hand from being cut.

In other words, with regard to the common process of separating the lid 1 from the container C, a user separates the lid 1 in the state in which the user presses part of the container C with a finger done hand in the state of inserting another finger of the hand into the pull tab 11 and holds the outer circumferential surface of the container with another hand.

In this case, there occurs an accident in which the finger used to press the part of the container C or a palm portion connected to this finger is cut by the edge of the lid 1. In the present invention, the cut prevention wall 21 is formed along the edge of the container C and thus minimizes the exposure of the sharp edge to a user side, thereby preventing the hand from being cut.

In this case, the cut prevention wall 21 is preferably formed to have a height of 1 to 3 mm. The reason for this is that when the height of the cut prevention wall 21 is formed higher or lower, the cut prevention wall does not function appropriately in the process of separating the can lid. In other words, although the cut prevention wall 21 should be bent inward when the can lid is concavely curved upward during the separation process, the effect is not relatively strong.

Furthermore, the cut prevention wall 21 is changed in shape in the process in which the plate 10 is separated from the container (C), which will be described in detail with reference to FIG. 3.

First, part of the tear-off portion 22 is separated from the container C by using the pull tab 11 in the state in which the plate 10 is coupled to the container C via the tear-off portion 22 of the cut prevention wall 21.

In this case, when the plate 10 is separated from the container, resisting force is generated from the non-separated part of the cut prevention wall 21, and thus there occurs the force pulling the separated part of the cut prevention wall in the direction of the non-separated part. Due to this, the cut prevention wall is bent toward the center of the bottom surface of the plate 10.

In other words, FIG. 3(*c*) shows a state in which the lid 1 is separated from the container C when viewed from the front. As shown in the drawing, the cut prevention wall 21 is bent toward the center of the bottom surface of the plate 10 while being separated from the container. The cut prevention wall 21 is bent to a relatively low degree on a side where the pull tab 11 is disposed, i.e., an upper end side in the drawing, and is bent to a relatively high degree at a location away from the pull tab 11. Accordingly, a hand may be prevented from being cut by the exposure of the tear-off portion 22 by preventing the tear-off portion 22 from being exposed to a user.

Figure 4A:
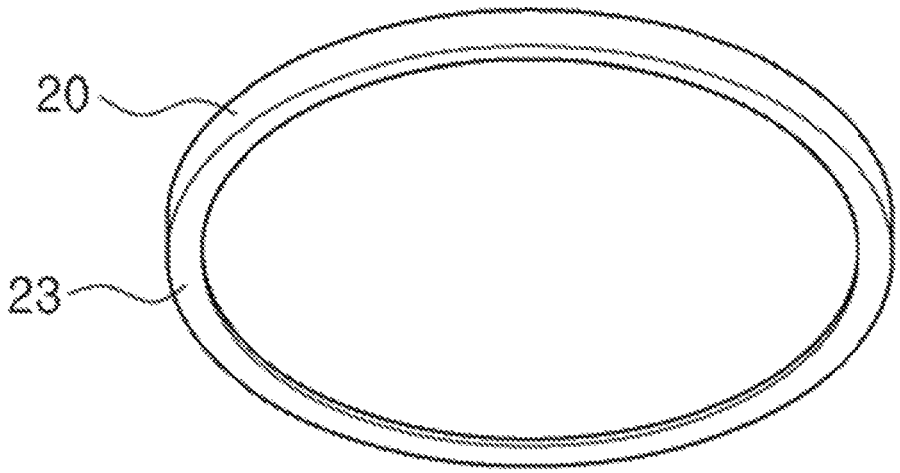
FIG. 4 is a view showing an example of another embodiment of the safety-enhanced can lid according to the present invention.
Figure 4B:
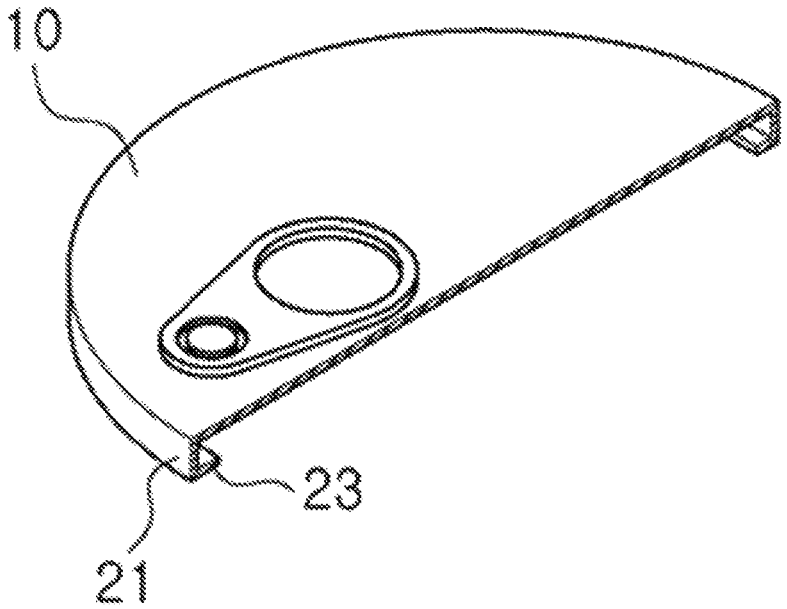

Meanwhile, FIG. 4 shows another embodiment of the can lid 1 according to the present invention, which further includes a flange 23 that extends inward from the cut prevention wall 21 and is coupled to the open top end of the container C.

Due to the configuration of the flange 23, the sharp edge of the plate is not provided toward a user laterally or downward, and thus the user's hand may be prevented from being cut in advance.

With regard to the general process of coupling the container and the lid to each other, the lid is pressed and fastened using strong pressure above the container filled with contents. The coupling flange 30 is coupled to the container through pressure applied from above.

Through this, effects are obtained in that the container and the lid may be coupled to each other without the major modification or alteration of the conventional manufacturing equipment and a user's hand may be prevented from being cut by the above-described cut prevention wall 21.

Regardless of the configuration of the flange 23, the top surface of the plate is concavely curved by the pressing force of the pull tab 11, and simultaneously the cut prevention wall 21 provided on the edge is inclined toward the center, thereby enabling cut prevention.

While the present invention has been described in conjunction with specific items such as specific components and the limited embodiments and drawings, this is provided merely to help a more comprehensive understanding of the present invention, and the present invention is limited to the above-described embodiments. It will be apparent to those having ordinary skill in the art to which the present invention pertains may make various modifications and variations from the foregoing description.

Therefore, the spirit of the present invention should not be defined based only on the above-described embodiments, and should not be determined, and all items including not only the claims to be described below but also modifications equal or equivalent to the claims should be construed as belonging to the scope of the spirit of the present invention.

What is claimed is:

1. A safety-enhanced can lid that is coupled to a top side of a container in which contents are stored, the safety-enhanced can lid comprising:

a plate (10); a pull tab (11); and a hand-cut prevention portion (20), wherein the plate (10) is laid to cover a top portion of the container (C) and composed of a flat plate, wherein the pull tab (11) is provided on a top surface of the plate (10), wherein the hand-cut prevention portion (20) includes a cut prevention wall (21) and a flange (23), wherein the cut prevention wall (21) extends downward from an edge of the plate (10) toward an opening of a top end of the container (C), wherein the cut prevention wall (21) is a continuum of the hand-cut prevention portion (20) to form one body with the hand-cut prevention portion (20), wherein the flange (23) extends from a front end of an edge of the cut prevention wall (21) toward a center of a bottom surface of the plate (10), wherein a bottom surface of the flange (23) is coupled to an edge of the opening of the top end of the container (10), wherein the bottom surface of the flange (23) is flat and extends parallel to the top surface of the plate (10), and wherein the top surface of the plate (10) is located at a higher level than the top end of the can container (C).

2. The safety-enhanced can lid of claim 1, wherein the cut prevention wall (21) is formed to have a vertical length of 1 to 3 mm.

3. The safety-enhanced can lid of claim 1, wherein the cut prevention wall (21) is bent toward the center of the bottom surface of the plate (10) when the plate (10) is separated from the container (C).

4. The safety-enhanced can lid of claim 2, wherein the cut prevention wall (21) is bent toward the center of the bottom surface of the plate (10) when the plate (10) is separated from the container (C).

* * * * *